US008181297B2

(12) United States Patent
Lee

(10) Patent No.: US 8,181,297 B2
(45) **Date of Patent: *May 22, 2012**

(54) SPRAY STEAM IN DRUM TYPE WASHER AND CONTROL METHOD

(75) Inventor: Youn Dong Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 551 days.

This patent is subject to a terminal disclaimer.

(21) Appl. No.: 11/629,321

(22) PCT Filed: Mar. 24, 2006

(86) PCT No.: PCT/KR2006/001091

§ 371 (c)(1),
(2), (4) Date: Jan. 26, 2009

(87) PCT Pub. No.: WO2006/101372

PCT Pub. Date: Sep. 28, 2006

(65) Prior Publication Data

US 2009/0151084 A1 Jun. 18, 2009

(30) Foreign Application Priority Data

Mar. 25, 2005 (KR) ..... 10-2005-0025055

(51) Int. Cl.
*D06F 39/04* (2006.01)

(52) U.S. Cl. ..... 8/149.1; 8/149.3; 68/15

(58) Field of Classification Search ..... 8/149.1–149.3, 8/158, 159

See application file for complete search history.

(56) References Cited

U.S. PATENT DOCUMENTS

| | | | | |
|---|---|---|---|---|
| 7,325,330 | B2 * | 2/2008 | Kim et al. | 34/407 |
| 2004/0237603 | A1 * | 12/2004 | Kim et al. | 68/15 |
| 2004/0255391 | A1 * | 12/2004 | Kim et al. | 8/149.3 |
| 2006/0016020 | A1 | 1/2006 | Park | |

FOREIGN PATENT DOCUMENTS

| | | | |
|---|---|---|---|
| CN | 1537995 | A | 10/2004 |
| DE | 19743508 | A1 | 4/1999 |
| EP | 1 555 338 | | 7/2005 |

(Continued)

*Primary Examiner* — Joseph L Perrin

(74) *Attorney, Agent, or Firm* — McKenna Long & Aldridge LLP

(57) ABSTRACT

A washing machine that performs a washing operation using eat high-temperature steam and a washing method of the same are disclosed. The washing method includes (a) driving a washing heater (40) mounted in a tub (56) to increase the interior temperature of the tub (56), and (b) driving a steam heater (74) mounted in a steam generation unit (70), such that high-temperature steam is generated and the high-temperature steam is supplied into the tub (56), to increase the interior temperature of the tub (56). A washing operation including the (a) step and the (b) step, which are combined either in the order of the (a) step->the (b) step->the (a) step or in the order of the (b) step->the (a) step->the (b) step, is carried out such that the interior temperature of the tub (56) is increased to a target temperature level. Consequently, the present invention has the effect of increasing the decomposition of detergent or contaminants by the provision of a washing algorithm, in which a washing water heating operation and a high-temperature steam injecting operation are combined, efficiently removing contaminants that are not removed only by heating the washing water, and, furthermore, increasing the sterilization efficiency.

16 Claims, 6 Drawing Sheets

FOREIGN PATENT DOCUMENTS

| | | |
|---|---|---|
| KR | 10-2002-0067352 | 8/2002 |
| KR | 10-2006-0101951 | 9/2006 |
| KR | 10-2007-0021649 | 2/2007 |
| KR | 10-2007-0059429 | 6/2007 |
| KR | 10-2008-0057725 | 6/2008 |
| WO | WO 2006/101362 | 9/2006 |

* cited by examiner

[Fig. 1]
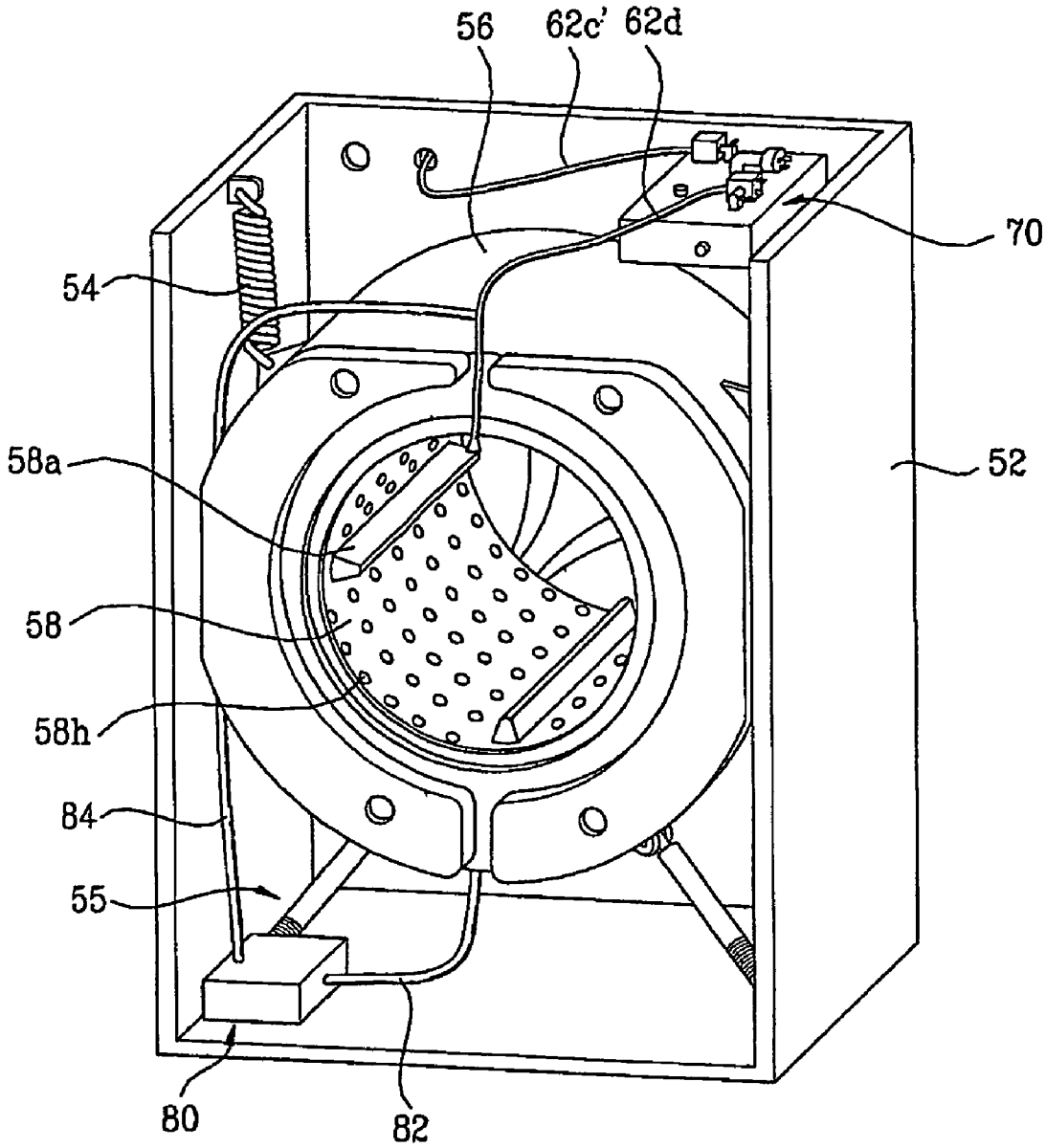

[Fig. 2]
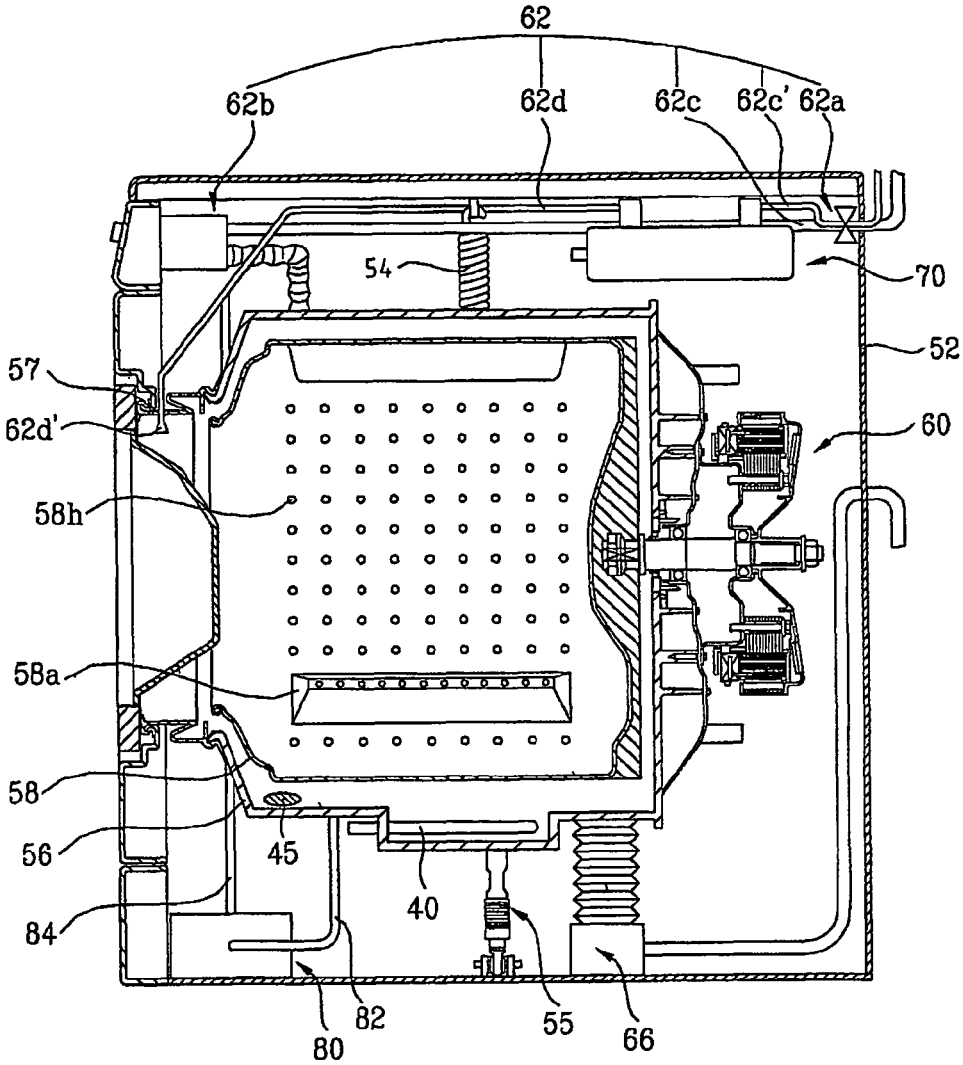
[Fig. 3]
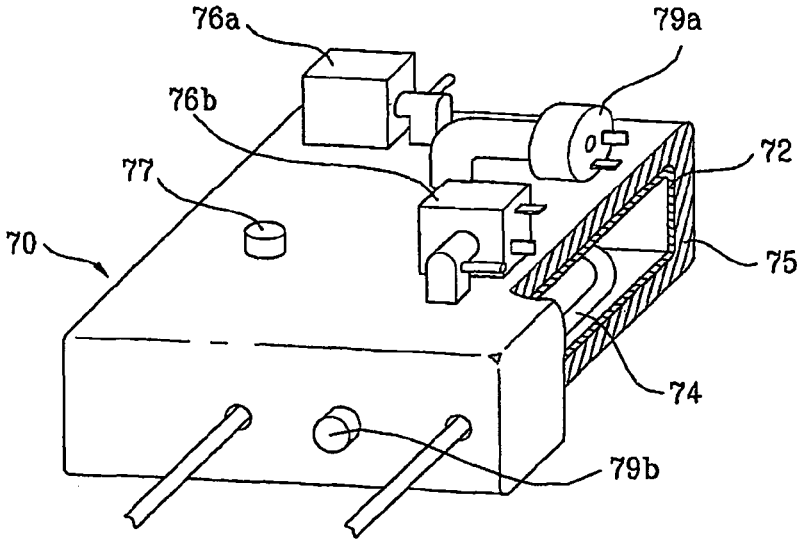

[Fig. 4]
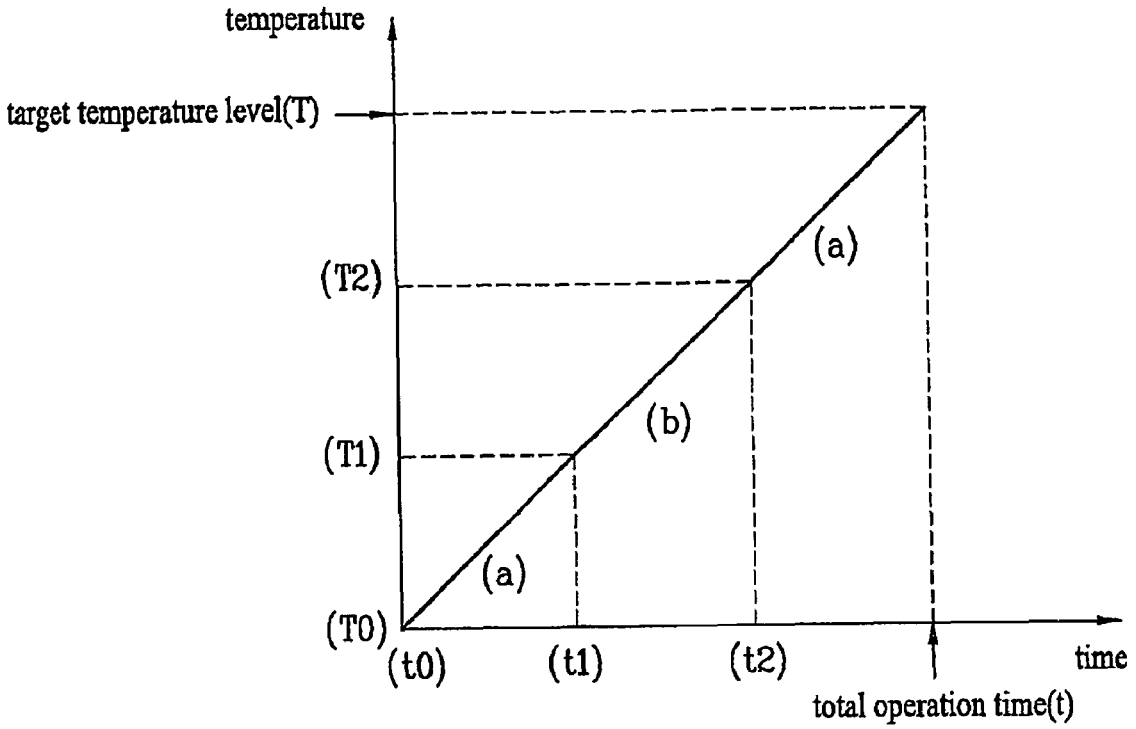
(a) washing heater
(b) steam heater
$$(T0 \sim T1) + (T2 \sim T) \gg (T1 \sim T2)$$
$$(t0 \sim t1) + (t2 \sim t) \gg (t1 \sim t2)$$

[Fig. 5]
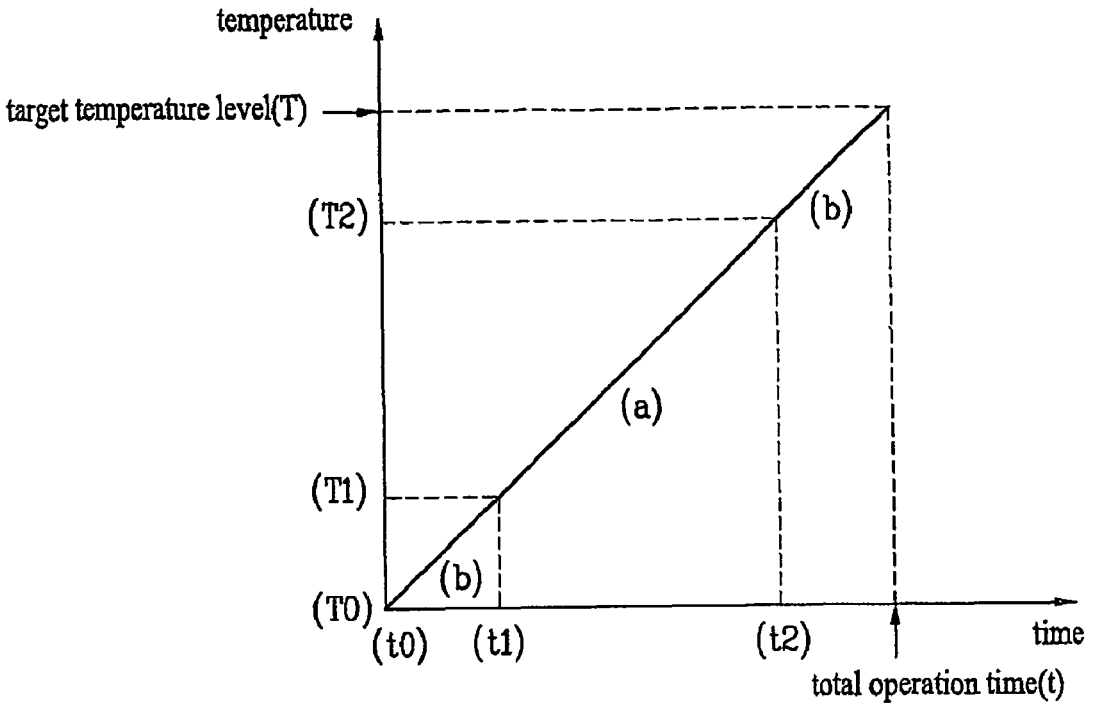
(a) washing heater
(b) steam heater
$$(T0 \sim T1) + (T2 \sim T) \ll (T1 \sim T2)$$
$$(t0 \sim t1) + (t2 \sim t) \ll (t1 \sim t2)$$

[Fig. 6]
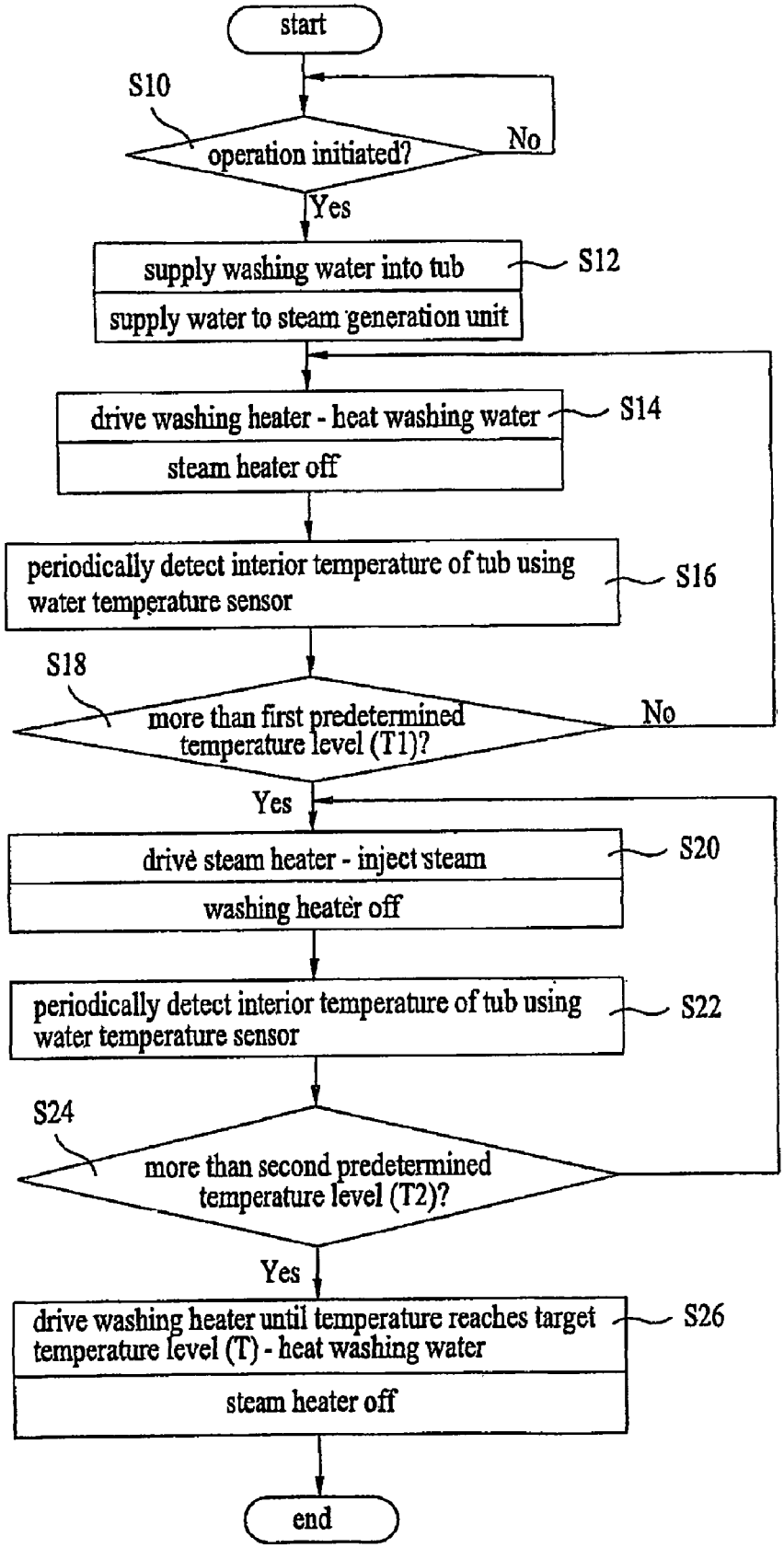

[Fig. 7]
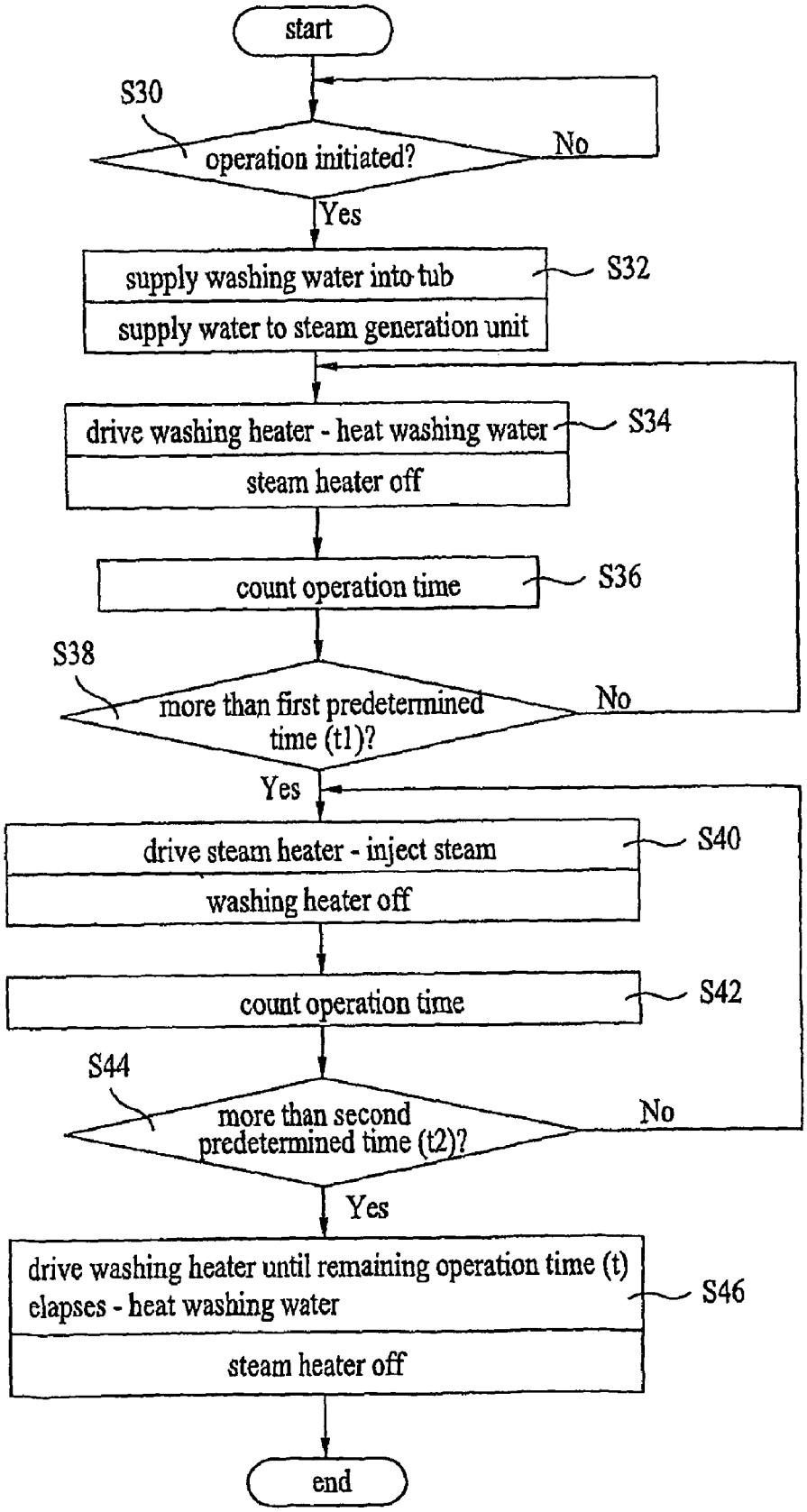

SPRAY STEAM IN DRUM TYPE WASHER AND CONTROL METHOD

This application claims the benefit of Korean Patent Application No. 2005-0025055, filed on Mar. 25, 2005 and PCT Application No. PCT/KR2006/001091, filed on Mar. 24, 2006, which is hereby incorporated by reference for all purposes as if fully set forth herein.

TECHNICAL FIELD

The present invention generally relates to a washing machine, and more particularly, to a washing machine that is capable of performing a washing operation using high-temperature steam generated by a steam generation unit mounted in the washing machine, and a washing method of the same.

BACKGROUND ART

Generally, washing machines are electric home appliances that are widely used at home. The washing machines are machines that remove contaminants from laundry, such as clothes or bedclothes, using emulsification of detergent, friction of washing water motion generated by the rotation, and impact applied to the laundry.

Washing machines are classified into a pulsator type washing machine, a drum of which is mounted in a vertical direction, and a drum type washing machine, the drum of which is mounted in a horizontal direction.

Normally, a washing operation is a course of supplying detergent and washing water to laundry to be washed such that contaminants can be removed from the laundry by a chemical action of the detergent contained in the washing water and a physical action of a drum.

A rinsing operation is a course of supplying washing water containing no detergent therein such that the detergent and contaminants can be rinsed out of the laundry, and a spin-drying operation is a course of rotating a washing tub at high speed, after the rinsing operation is completed, such that moisture can be removed from the laundry.

In recent years, a so-called well-being culture has been popularized according to the improvement in the standard of living. As a result, demands for a health-oriented life style, in which health is considered the most important, are being increased.

It is natural that washing machines reflect such cultural change or such demands of consumers.

DISCLOSURE OF INVENTION

Technical Problem

When detergent or bacilli are left in washed laundry, the detergent or the bacilli may damage the skin's health, and users may feel displeased and uncomfortable.

Specifically, a conventional algorithm, in which a washing operation, a rinsing operation, and a spin-drying operation are combined, does not completely remove contaminants from laundry, i.e., deteriorates the washing performance, and does not satisfy the healthy lives desired by consumers.

Technical Solution

Therefore, the present invention has been made in view of the above problems, and it is an object of the present invention to provide a steam-injection type washing machine adopting a novel washing system, and a washing method of the same.

It is another object of the present invention to provide a steam-injection type washing machine that is capable of more efficiently removing detergent or contaminants, thereby maximizing the washing performance, and a washing method of the same.

Additional advantages, objects, and features of the present invention will be set forth in part in the following descriptions of preferred embodiments.

The object of the present invention can be achieved by providing a steam-injection type washing machine comprising: a washing heater mounted in a tub; a steam heater mounted in a steam generation unit for generating high-temperature steam and supplying the high-temperature steam into the tub; and a control unit for selectively driving the washing heater and the steam heater for a predetermined operation time such that the interior temperature of the tub is increased, whereby a washing operation is carried out.

In another aspect of the present invention, provided herein is a steam-injection type washing machine comprising: a washing heater mounted in a tub; a steam heater mounted in a steam generation unit for generating high-temperature steam and supplying the high-temperature steam into the tub; a temperature detection unit mounted in the tub for detecting the interior temperature of the tub; and a control unit for selectively driving the washing heater and the steam heater based on the interior temperature of the tub detected by the temperature detection unit such that the interior temperature of the tub is increased to a target temperature level by the operation of the washing heater or the steam heater, whereby a washing operation is carried out.

The present invention is characterized in that, during the washing operation, the control unit sequentially drives the washing heater and the steam heater in the order of the washing heater->the steam heater->the washing heater, whereby the washing operation is carried out.

Alternatively, the present invention is characterized in that, during the washing operation, the control unit sequentially drives the washing heater and the steam heater in the order of the steam heater->the washing heater->the steam heater, whereby the washing operation is carried out.

In another aspect of the present invention, provided herein is a washing method of a steam-injection type washing machine comprising the steps of: (a) driving a washing heater mounted in a tub to increase the interior temperature of the tub; and (b) driving a steam heater mounted in a steam generation unit, such that high-temperature steam is generated and the high-temperature steam is supplied into the tub, to increase the interior temperature of the tub, wherein a washing operation including the (a) step and the (b) step, which are combined either in the order of the (a) step->the (b) step->the (a) step or in the order of the (b) step->the (a) step->the (b) step, is carried out for a predetermined operation time.

Preferably, in the total operation time required for the washing operation, the operation time required to carry out the (a) step is greater than the operation time required to carry out the (b) step.

In a further aspect of the present invention, provided herein is a washing method of a steam-injection type washing machine comprising the steps of: (a) driving a washing heater mounted in a tub to increase the interior temperature of the tub; and (b) driving a steam heater mounted in a steam generation unit, such that high-temperature steam is generated and the high-temperature steam is supplied into the tub, to increase the interior temperature of the tub, wherein a washing operation including the (a) step and the (b) step, which are combined either in the order of the (a) step->the (b) step->the (a) step or in the order of the (b) step->the (a) step->the (b)

step, is carried out such that the interior temperature of the tub is increased to a target temperature level.

Preferably, the temperature increase rate accomplished through the (a) step is greater than the temperature increase rate accomplished through the (b) step until the interior temperature of the tub reaches the target temperature level.

ADVANTAGEOUS EFFECTS

The washing method of the steam-injection type drum washing machine according to the present invention has the effect of increasing the decomposition of detergent or contaminants by the provision of a washing algorithm, in which a washing water heating operation and a high-temperature steam injecting operation are combined/efficiently removing contaminants that are not removed only by heating the washing water, and, furthermore, increasing the sterilization efficiency.

Consequently, the washing method of the steam-injection type drum washing machine according to the present invention has the effect of maximizing the washing performance and the sterilization efficiency of the washing machine through the washing algorithm, thereby greatly improving the satisfaction of consumers with respect to the products.

BRIEF DESCRIPTION OF THE DRAWINGS

The accompanying drawings, which are included to provide a further understanding of the invention, illustrate embodiments of the invention and together with the description serve to explain the principle of the invention.

In the drawings:

FIG. 1 is a perspective view illustrating a steam-injection type washing machine according to the present invention.

FIG. 2 is a side view, in section, of the steam-injection type washing machine according to the present invention.

FIG. 3 is a perspective view illustrating a steam generation unit according to the present invention.

FIG. 4 is a graph illustrating a washing algorithm combination according to a first preferred embodiment of the present invention.

FIG. 5 is a graph illustrating a washing algorithm combination according to a second preferred embodiment of the present invention.

FIG. 6 is a flow chart illustrating a washing method performed in consideration of the interior temperature of a tub based on the washing algorithm according to the first preferred embodiment of the present invention.

FIG. 7 is a flow chart illustrating a washing method performed in consideration of the washing progress time based on the washing algorithm according to the first preferred embodiment of the present invention.

BEST MODE FOR CARRYING OUT THE INVENTION

Reference will now be made in detail to the preferred embodiments of the present invention, examples of which are illustrated in the accompanying drawings.

First, a steam-injection type washing machine including a steam generation unit, which injects high-temperature steam, will be described with reference to FIGS. 1 to 3.

The steam-injection type washing machine according to the present invention includes a cabinet 52 forming the external appearance of the washing machine, a tub 56 mounted in the cabinet 52 in such a manner that the tub 56 is suspended by means of a spring, and, at the same time, the tub 56 is supported by a damper assembly 55, a drum 58 rotatably mounted inside the tub 56 for receiving washing water and laundry, lifts 58*a* mounted at the inner wall of the drum 58, such that the lifts 58*a* protrude inwardly from the inner wall of the drum 58, and the lifts 58*a* are arranged at pre-determined intervals, for lifting and dropping the laundry as the drum 59 is rotated, a motor 60 connected to the drum 58 at the rear of the tub 56 for rotating the drum 58, a steam generation unit 70 mounted above the tub 56 for heating the washing water into high-temperature and high-pressure steam and supplying the steam into the tub 56 and the drum 58, a pump unit 80 mounted between the lower end of the tub 56 and the steam generation unit 70 for pumping out the washing water in the tub 56 such that the pumped washing water can circulated to the upper side of the tub 56.

The steam-injection type washing machine according to the present invention further includes a water supply unit 62 for supplying washing water into the tub 56 and the drum 58, and a drainage pump assembly 66 for draining the washing water. The steam generation unit 70 is connected to the water supply unit 62.

Specifically, the water supply unit 62 includes a water supply valve assembly 62*a* mounted at the rear of the cabinet 52 for controlling supply of water, a detergent box assembly 62*b* connected between the water supply valve assembly 62*a* and the tub 56 for storing detergent, first and second water supply channels 62*c* and 62*c*' connected to the detergent box assembly 62*b* and the steam generation unit 70 from the water supply valve assembly 62*a*, respectively, and a steam channel 62*d*, having one end connected to the steam generation unit 70 and the other end located in the tub 56 and the drum 58, for supplying steam into the tub 56 and the drum 58 therethrough.

In the inner wall of the drum 58 are formed a plurality of water holes 58*h*, through which the washing water can flow to the drum 58 and the tub 56. Also, when a spin-drying operation is performed, the washing water can escape from the laundry through the water holes 58*h* by a centrifugal force. The water supply valve assembly 62*a* and the drainage pump assembly 66 include a water supply valve (not shown) and a drainage pump (not shown), respectively, such that washing water can be supplied or drained according to the operation of the water supply valve or the drainage pump.

In the lower part of the tub 56 is mounted a washing heater 40 for heating the washing water in the tub 56 to a high-temperature level such that the washing performance of the washing machine is improved. In the lower part of the tub 56 is also mounted a temperature detection unit 45 for detecting the temperature of the washing water circulating through the tub 56 and transmitting the detected temperature to a control unit (not shown), which controls the whole system.

The first water supply channel 62*c* is connected to the detergent box assembly 62*b* from the water supply valve assembly 62*a* such that the washing water can be supplied into the drum 58 through first water supply channel 62*c*. The second water supply channel 62*c*' is connected to the steam generation unit 70 from the water supply valve assembly 62*a* such that the washing water can be supplied into the steam generation unit 70 through second water supply channel 62*c*'.

Also, the steam channel 62*d* has one end 62*d*' which is constructed in the shape of a nozzle such that steam can be injected at high speed through the nozzle-shaped end 62*d*'. The end 62*d*' of the steam channel 62*d* extends through a gasket 57, which is connected between the tub 56 and the cabinet 52, such that the end 62*d*' of the steam channel 62*d* is located in the tub 56 and the drum 58.

Especially, as shown in FIG. 3, the steam generation unit includes a hermetically-sealed pressure container 72 for storing washing water supplied through the second water supply channel 62*c*', a steam heater 74 mounted in the pressure container 72 for heating washing water, an inlet valve 76*a* mounted between the second water supply channel 62*c*' and the pressure container 72 for controlling the supply of the washing water, and an outlet valve 76*b* mounted between the steam channel 62*d* and the pressure container 72 for controlling the discharge of the steam.

Here, the inlet valve 76*a* and the outlet valve 76*b* are pressure valves that are opened and dosed according to the inner pressure of the pressure container 72. The inlet valve 76*a* and the outlet valve 76*b* may be electronically or mechanically controlled such that the inlet valve 76*a* is opened when the interior pressure of the pressure container 72 is less than a predetermined pressure level and the outlet valve 76*b* is opened when the interior pressure of the pressure container 72 is greater than the predetermined pressure level.

The steam heater 74 is mounted in the lower part of the pressure container 72 such that washing water can be heated by the steam heater 74 even when a predetermined amount of washing water is supplied into the pressure container 72.

Also, the steam generation unit 70 further includes a temperature sensor 77 mounted at the upper part of the pressure container 72 for interrupting the operation of the outlet valve 76*b* when the temperature of the steam in the pressure container 72 is greater than a predetermined temperature level (T0), an automatic pressure switch 79*a* mounted at one side of the temperature sensor 77 for primarily interrupting the operation of the steam heater 74 when the interior temperature of the pressure container 72 is less than a predetermined pressure level (P0), and an automatic temperature switch 79*b*, such as a thermostat, mounted at one side of the steam heater 74 for secondarily interrupting the operation of the steam heater 74 when the temperature of the steam heater 74 is greater than a predetermined temperature level (T1).

Of course, additional automatic temperature switches 79*b* may be provided for preventing the steam heater 74 from overheating when the automatic pressure switch 79*a* is not normally operated or when there is leakage from the pressure container 72.

In addition, the steam generation unit 70 further includes an insulating member 75, such as Styrofoam, surrounding the outside of the pressure container 72 for preventing the generation of heat loss from the pressure container 72 while the steam heater 74 is operated.

On the other hand, the steam generation unit 70 may further include a water level sensor (not shown) mounted in the pressure container 72 for detecting the amount of water supplied into/stored in the pressure container 72.

In the steam generation unit 70 with the above-stated construction, the operations of the steam heater 74; the inlet valve 76*a*, and the outlet valve 76*b* are controlled by the control unit, which controls the operation of the washing machine.

The pump unit 80 is connected to the tub 56 through a circulating channel 82. Also, the pump unit 80 is connected to the steam channel 62*d* through a second circulating channel 74. The pump unit 80 serves to pump out the washing water in the tub 56 such that the washing water can be circulated.

Hereinafter, a washing operation control method of the steam-injection type washing machine with the above-stated construction according to the present invention will be described.

In a washing operation to heat the interior temperature of the tub 56, a mode of driving the washing heater 40 mounted in the tub 56 (hereinafter, referred to as an "(a) course") or a mode of driving the steam heater 74 mounted in the steam generation unit 70 (hereinafter, referred to as a "(b) course") may be used.

In this case, it is preferable that the washing heater 40 have higher output than the steam heater 74.

The present invention is characterized in that a washing algorithm, in which the (a) course and the (b) course are selectively combined, is provided in the washing operation to heat the interior temperature of the tub 56 to a target temperature level.

FIG. 4 is a graph illustrating a washing algorithm according to a first preferred embodiment of the present invention, and FIG. 5 is a graph illustrating a washing algorithm according to a second preferred embodiment of the present invention.

In the washing algorithm according to the first preferred embodiment of the present invention, as shown in FIG. 4, the (a) course is carried out, the (b) course is carried out, and then the (a) course is carried out again, such that the interior temperature of the tub 56 is heated to the target temperature level.

At this time, it is preferable to set the operation time of the two (a) courses in the total operation time (t) such that the operation time of the two (a) courses is greater than the operation time of the (b) course. In order to satisfy the above condition, it is also preferable to decide a time (t1) at which the transition from the (a) course to the (b) course is made and a time (t2) at which the transition from the (b) course to the (a) course is made.

Alternatively, it is preferable to set the temperature increase rate accomplished through the two (a) courses such that the temperature increase rate accomplished through the two (a) courses is greater than the temperature increase rate accomplished through the (b) course until the interior temperature of the tub 56 is heated to a target temperature level (T). In order to satisfy the above condition, it is also preferable to decide a temperature level (T1) at which the transition from the (a) course to the (b) course is made and a temperature level (T2) at which the transition from the (b) course to the (a) course is made.

In the washing algorithm according to the second preferred embodiment of the present invention, on the other hand, as shown in FIG. 5, the (b) course is carried out, the (a) course is carried out, and then the (b) course is carried out again.

At this time, it is preferable to set the operation time of the (a) course in the total operation time (t) such that the operation time of the (a) course is greater than the operation time of the two (b) courses. In order to satisfy the above condition, it is also preferable to decide a time (t1) at which the transition from the (b) course to the (a) course is made and a time (t2) at which the transition from the (a) course to the (b) course is made.

Alternatively, it is preferable to set the temperature increase rate accomplished through the (a) course such that the temperature increase rate accomplished through the (a) course is greater than the temperature increase rate accomplished through the two (b) courses until the interior temperature of the tub 56 is heated to a target temperature level (T). In order to satisfy the above condition, it is also preferable to decide a temperature level (T1) at which the transition from the (b) course to the (a) course is made and a temperature level (T2) at which the transition from the (a) course to the (b) course is made.

According to the first and second preferred embodiments of the present invention, the washing algorithm is performed while the interior temperature of the tub 56 is directly monitored by the temperature detection unit 45 such that the interior temperature of the tub 56 reaches the target temperature level (T).

In the case that the temperature detection unit 45 is not used, on the other hand, the total operation time (t) required for the interior temperature of the tub 56 to reach the target temperature level is preliminarily defined, and the washing algorithm is performed during the total operation time (t).

Hereinafter, a washing method performed based on the washing algorithm, in which the (a) course and the (b) course are selectively combined, will be described in detail.

FIG. 6 is a flow chart illustrating a washing method performed according to the interior temperature of the tub based on the washing algorithm according to the first preferred embodiment of the present invention, and FIG. 7 is a flow chart illustrating a washing method performed in consideration of the washing progress time based on the washing algorithm according to the first preferred embodiment of the present invention.

First, as shown in FIG. 6, when a washing operation is initiated by the request of a user (S10), washing water is supplied into the tub 56 and the drum 58, and, at the same time, washing water is also supplied to the steam generation unit 70 (S12).

After the supply of washing water is completed, only the washing heater 40 is driven, while the steam heater 74 is off, such that the washing water supplied into the tub 56 is heated (S14).

While the washing water is heated by the operation of the washing heater 40, the pump unit 80 is driven such that the washing water in the tub 56 is pumped out and circulated to the upper side of the tub 56.

At this time, the reason why the washing water is heated using the washing heater 40 is to increase the decomposition of detergent or contaminants such that the detergent and the contaminants can be more easily removed by a thermal action of the heated water.

As the washing water in the tub 56 is heated, the interior temperature of the drum 58 is increased. The interior temperature of the drum is periodically detected by the temperature detection unit 45 (S16).

It is determined whether the current interior temperature of the drum has reached the first predetermined temperature level (T1) (S18). When it is determined that the current interior temperature of the drum has reached the first predetermined temperature level (T1), the operation of the washing heater 40 is interrupted, and the steam generation unit 70 is driven.

In other words, the steam heater 74 is operated to heat the washing water supplied into the steam generation unit 70 such that high-temperature steam is generated, and the generated high-temperature steam is injected into the tub 56 (S20).

The reason why the steam generation unit 70 is driven to inject the high-temperature steam into the drum is to remove contaminants that are not removed only by heating the washing water, and, furthermore, increase the sterilization efficiency.

The interior temperature of the drum is further increased by the high-temperature steam injected from the steam generation unit 70, and the interior temperature of the drum is detected by the temperature detection unit 45 (S22).

At this time, it is determined whether the current interior temperature of the drum has reached the second predetermined temperature level (T2) (S24). When it is determined that the current interior temperature of the drum has reached the first pre-determined temperature level (T2) through the high-temperature steam injection, only the washing heater 40 is driven, while the steam heater 74 is off, such that the washing water supplied into the tub 56 is heated (S26).

At the step S26, the washing heater 40 is driven until the interior temperature of the drum reaches the target temperature level (T). When the interior temperature of the drum reaches the target temperature level (T), the washing operation is completed while both the washing heater 40 and the steam heater 74 are off.

Here, it is preferable to set the first predetermined temperature level (T1), the second predetermined temperature level (T2), and the target temperature level (T) such that a condition of the first predetermined temperature level (T1)<the second pre-determined temperature level (T2)<the target temperature level (T) is satisfied.

In the first preferred embodiment as described above, the washing heater 40 and the steam heater 74 are selectively driven in the order of the (a) course->the (b) course->the (c) course while the interior temperature of the drum is monitored by the temperature detection unit 45. In this way, the washing operation is carried out.

In the first preferred embodiment of the present invention, as shown in FIG. 7, on the other hand, the total operation time (t) required for the interior temperature of the drum to reach the target temperature level is preliminarily defined without monitoring the interior temperature of the drum, and the total operation time is divided into two (a) courses and one (b) course, based on which the washing operation is carried out.

When the washing operation is initiated (S30), as shown in the drawing, water is supplied to the tub 56 and the steam generation unit 70 (S32), and the (a) course for driving the washing heater 40 is carried out (S34).

The operation time is counted from immediately after the (a) course is initiated (S36). When the counted operation time exceeds the first predetermined time (t1) (S38), the operation of the washing heater 40 is interrupted, and the (b) course is carried out. That is, the steam heater 74 is driven to heat the interior temperature of the tub (S40).

Subsequently, when the operation time counted from immediately after the (a) course is initiated exceeds the predetermined time (t2) (S42, S44), the operation of the steam heater 74 is interrupted, and the (a) course is carried out again.

At this time, the (a) course is continuously carried out until the counted operation time reaches the total operation time (t).

Specifically, in the case that the temperature detection unit 45 is not used, the washing heater 40 and the steam heater 74 are selectively driven in the order of the (a) course->the (b) course->the (c) course while the operation time is counted. In this way, the washing operation is carried out.

Although drawings and a detailed description of the second preferred embodiment of the present invention are omitted, the (a) course and the (b) course are carried out in the predetermined order similar to that of the first preferred embodiment according to a washing algorithm, in which the (a) course and the (b) course are combined in the order as shown in FIG. 5.

Consequently, the washing operation according to the present invention is a combination of the washing water heating operation performed by the operation of the washing heater 40 and the high-temperature steam injecting operation performed by the operation of the steam generation unit 70.

According to the washing method of the steam-injection type drum washing machine with the above-stated construction, the washing water is heated to primarily increase the decomposition of the detergent or the contaminants, and the high-temperature steam is injected to remove contaminants that are not removed only by heating the washing water, and, at the same time, increase the sterilization efficiency.

Consequently, the washing performance and the sterilization efficiency of the drum washing machine are improved through the washing algorithm of the present invention, and therefore, the satisfaction of users with respect to the product is further increased.

It will be apparent to those skilled in the art that various modifications and variations can be made in the present invention without departing from the spirit or scope of the invention.

Thus, it is intended that the present invention cover the modifications and variations of this invention provided they come within the scope of the appended claims and their equivalents.

The invention claimed is:

1. A controlling method of a horizontally rotated drum-type washing machine including a steam heater to generate steam and a washing heater to heat water in the tub, comprising:

increasing an interior temperature of a tub by supplying steam into the tub and heating water in the tub, wherein the increasing of the temperature includes operating the steam heater to generate steam and the washing heater to heat the water in the tub, and wherein the operating of the heaters includes operating the heaters alternately, and wherein the increasing of the temperature is performed until the interior temperature reaches a preset temperature (T).

2. The controlling method of claim 1, wherein the operating of the heaters includes operating the heaters based on respective preset temperatures.

3. The controlling method of claim 1, wherein the operating of the heaters starts and ends with operating the steam heater or the washing heater.

4. The controlling method of claim 1, wherein the operating of the heaters includes operating the heaters in order of the steam heater, the washing heater, and the steam heater or in order of the washing heater, the steam heater, and the washing heater.

5. The controlling method of claim 4, wherein the orderly operating of the heaters includes operating the steam heater until the interior temperature reaches a first preset temperature (Ti), operating the washing heater until the interior temperature reaches a second preset temperature (T2), and operating the steam heater until the interior temperature reaches the preset temperature (T).

6. The controlling method of claim 4, wherein the orderly operating of the heaters includes operating the washing heater until the interior temperature reaches a first preset temperature (T1), operating the steam heater until the interior temperature reaches a second preset temperature (T2), and operating the washing heater until the interior temperature reaches the preset temperature (T).

7. The controlling method of claim 1, wherein the increasing of the temperature is performed for a preset period of time (t).

8. The controlling method of claim 7, wherein the operating of the heaters includes operating the heaters for respective preset periods of time.

9. The controlling method of claim 8, wherein the preset period of time for the washing heater is longer than the preset period of time for the steam heater.

10. The controlling method of claim 7, wherein the operating of the heaters starts and ends with operating the steam heater or the washing heater.

11. The controlling method of claim 8, wherein the operating of the heaters includes operating the heaters in order of the steam heater, the washing heater, and the steam heater or in order of the washing heater, the steam heater, and the washing heater.

12. The controlling method of claim 11, wherein the orderly operating of the heaters includes operating the steam heater for a first period of time (ti), operating the washing heater for a second period of time (t2), and operating the steam heater until the preset period of time (t) is reached.

13. The controlling method of claim 11, wherein the orderly operating of the heaters includes operating the washing heater for a first period of time (ti), operating the steam heater for a second period of time (t2), and operating the washing heater until the preset period of time (t) is reached.

14. The controlling method of claim 1, wherein the washing heater has higher temperature output than the steam heater.

15. The controlling method of claim 1, wherein a total operation time of the washing heater is greater than that of the steam heater.

16. The controlling method of claim 1, wherein a total temperature increased due to the washing heater is greater than that due to the steam heater.

* * * * *